US006349830B1

(12) United States Patent
Lebron

(10) Patent No.: US 6,349,830 B1
(45) Date of Patent: Feb. 26, 2002

(54) REPLACEMENT PART MATCHING METHOD AND SYSTEM

(75) Inventor: Greg Lebron, Veronk, NJ (US)

(73) Assignee: Gemini Industries, Inc., Clifton, NJ (US)

( * ) Notice: Subject to any disclaimer, the term of this patent is extended or adjusted under 35 U.S.C. 154(b) by 0 days.

(21) Appl. No.: 09/603,038

(22) Filed: Jun. 26, 2000

(51) Int. Cl.[7] ..... B65D 73/00

(52) U.S. Cl. ..... 206/461; 206/459.5; 206/703; 206/462

(58) Field of Search ..... 206/461, 459.5, 206/703, 462, 467, 471

(56) References Cited

U.S. PATENT DOCUMENTS 2,475,450 A * 7/1949 Dvorak ..... 33/555.2
3,416,650 A * 12/1968 Mortensen ..... 206/230
3,703,234 A * 11/1972 Howard ..... 206/349
4,165,805 A * 8/1979 Fethke et al. ..... 206/349
4,899,877 A * 2/1990 Kierman ..... 206/349
5,293,997 A * 3/1994 Hustad et al. ..... 206/467
5,735,404 A * 4/1998 Kumakura et al. ..... 206/469
5,803,253 A * 9/1998 Zakarian ..... 206/349

* cited by examiner

*Primary Examiner*—Paul T. Sewell
*Assistant Examiner*—Troy Arnold
(74) *Attorney, Agent, or Firm*—Skadden, Arps, Slate, Meagher & Flom LLP

(57) ABSTRACT

A system for matching a replacement part coupling interface with the coupling interface of a spent part. The matching feature reduces the likelihood of an incorrect selection of a replacement part. The matching system can be used to properly select a battery pack for cordless telephone handsets by making it possible to physically check the compatibility of the plug without the need to open or remove the product from its packaging.

10 Claims, 3 Drawing Sheets

REPLACEMENT PART MATCHING METHOD AND SYSTEM

FIELD OF THE INVENTION

The present invention relates to replacement parts. More particularly, the invention relates to the process of selecting a replacement part for a particular product.

BACKGROUND ON THE INVENTION

Many devices include parts that, by design or circumstance wear out faster than the device as a whole. Such parts are generally intended to be replaced by the manufacturer, and are therefore sold separately from the device as replacement parts. Often times more than one source exists for the part, and several devices are able to employ the same replacement part. Customers are not always able to determine whether a part is proper for the device without actually placing it within the device. For example, the replacement part may include a special coupling interface that is unique to the device. One example where customers have particular difficulty properly identifying correct parts concerns finding replacement batteries for cordless telephone units.

Therefore, there is a need for a method and system for assisting customers in identifying a compatible replacement part for cordless telephone handsets and other devices for which replacement parts may be sold.

SUMMARY OF THE INVENTION

The present invention provides a replacement part coupling interface matching system by providing a simulated coupling interface within the part's packaging. In one embodiment, the matching system includes a product packaging portion, the product packaging portion being adapted to substantially contain the replacement part. The system also includes a planer portion extending from the product packaging portion and a coupling interface within the planer portion. The coupling interface is adapted to couple to the coupling interface of the replacement part.

In another embodiment, the invention provides a method for facilitating the matching of a replacement part coupling interface with the coupling interface of a spent part. The method includes providing the replacement part in a substantially closed packaging. The method then provides a coupling portion on a section of the packaging. The coupling portion provided by the method is adapted to mate with the coupling portion of the replacement part such that the coupling portion of the replacement part substantially fits the coupling portion on the packaging. The method matches the replacement part coupling interface with the coupling interface of the spent part by the coupling interface of the spent part fitting within the coupling portion on the packaging associated with the replacement part. These and other advantages of the present invention will be apparent from the description below.

DETAILED DESCRIPTION

The present invention will now be discussed with reference to illustrations of an embodiment of a replacement part coupling interface matching system ("matching system"). The illustrated matching system is for matching the plug of a spent cordless phone battery with a replacement phone battery plug. However, the invention is equally applicable to other replacement parts which include a coupling interface that varies between replacement parts of the same kind. Additionally, the term "replacement part," as used herein, is not strictly limited to kind-for-kind replacements, but includes optional, "add-on" parts as well. For example, the invention is applicable to cellular telephone charging cords which include a coupling interface that is unique to the cellular telephone. By way of further example, the invention is also applicable to replacement headlights for automobiles. Other applications will be apparent.

Cordless telephone systems, of the type used with conventional land-based telephone lines, normally consist of a base unit and a self-contained, detachable, handset unit. Power for the handset unit is supplied internally, typically by rechargeable, nickel cadmium (NiCd) battery packs. After several charging cycles, the battery packs in the handsets will eventually lose their recharging capacity and hence should be replaced.

Battery pack replacement for cordless telephones is particularly challenging because different cordless telephone models generally use battery packs that are similar in appearance, but are not functionally interchangeable. Accordingly, a consumer may select what appears to be a correct replacement battery from the display rack in a store, only to later discover that it is not compatible with his or her phone. This problem is currently addressed by including battery specifications and illustrations of the plug type on the product information card. However, the specification data and plug type illustrations do not facilitate a positive identification of the correct battery. There are several comparison steps taken by the consumer which may introduce an erroneous selection.

Figure 1:
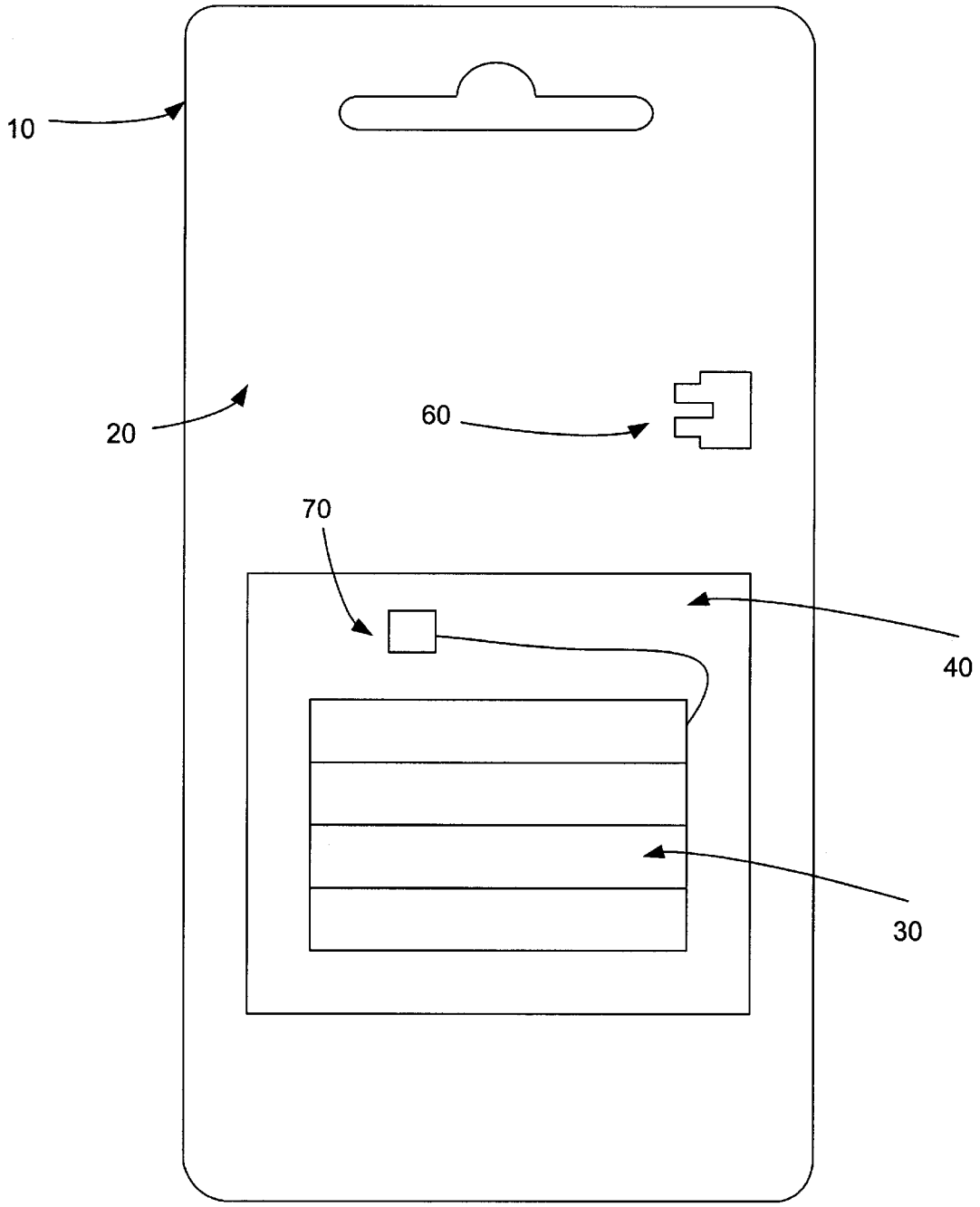
FIG. 1 illustrates a front view of a product packaging portion that includes a coupling interface matching system in accordance with the invention.
Figure 2:
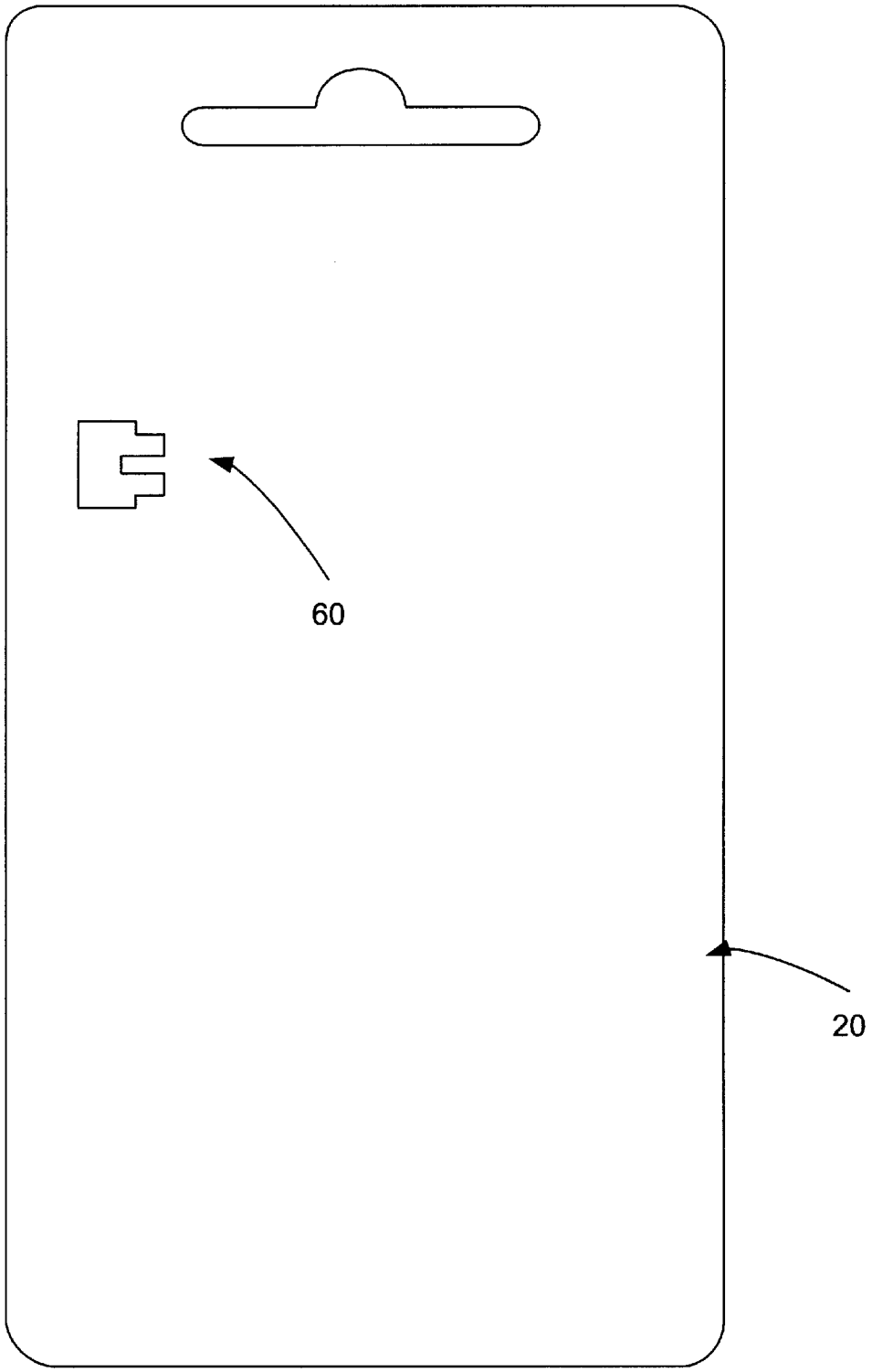
FIG. 2 illustrates a rear view of the product packaging portion of FIG. 1.

An embodiment of a replacement battery matching system 10 is illustrated in FIGS. 1 and 2. The matching system 10 includes a backing card 20, a transparent bubble portion 40, an opening for hanging the blister pack on a display rack, and a plug matching portion 60. An area 30 within the bubble portion 40 is adapted to hold a replacement battery.

In a preferred embodiment, the backing card 20 is substantially planer so as to provide a suitable support surface for the plug matching portion 60. Accordingly, the packaging need not include a larger substantially planer portion than the one needed so as to accommodate the plug matching portion 60. Thus, in a preferred embodiment, the plug matching portion 60 is an opening cut into the body of the backing card and enclosing blister pack. In an alternate embodiment, the substantially planer portion is a small tab, which includes the plug matching portion 60, and is rigidly affixed to the bubble portion 40.

The matching system 10 facilitates the identification of a proper replacement battery by providing a backing card 20 that incorporates a "plug matching" portion 60. The plug matching portion 60 is adapted to mate with the plug of the replacement battery inside the bubble portion 40.

In one embodiment, the plug matching portion 60 is an opening that matches a cross section of the plug. In the case of a multi-prong plug, such as an automobile headlight, the opening may comprise a plurality of openings configure 4 to match the prongs of the plug. In another embodiment, the plug matching portion is a dummy coupling plug that is adapted to couple to the battery plug. For example, the plug matching portion may include the exterior molding for a female battery connector plug or a male battery connector plug.

One important feature of the invention is that the plug matching portion can be accessed without opening the packaging. Thus, the invention alleviates the need to return products to the store or complication inherent in returning open packages.

Figure 3:
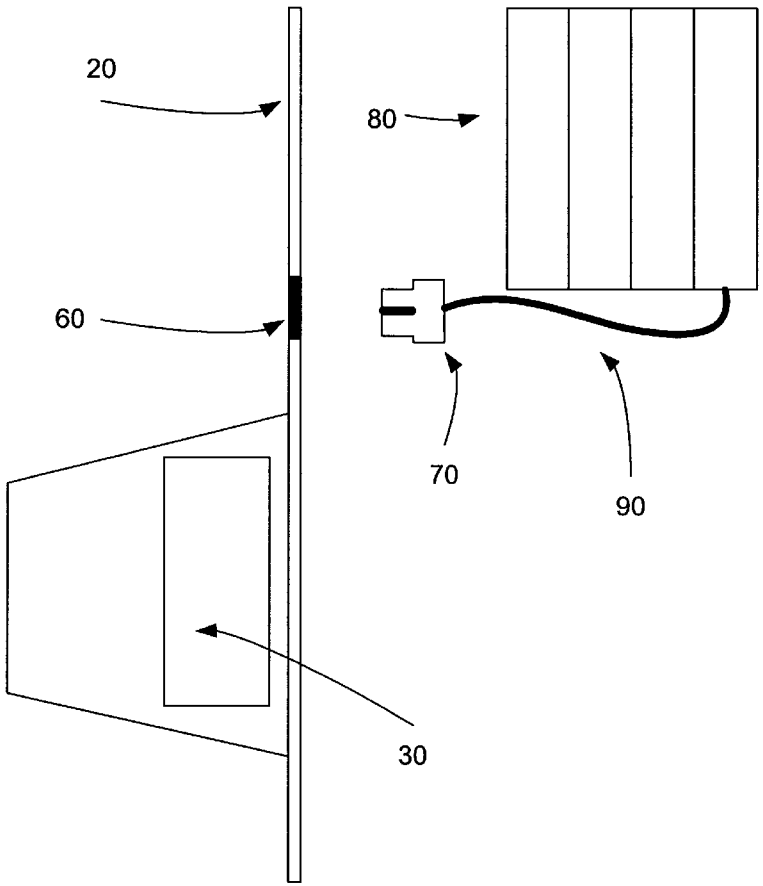
FIG. 3 is an exploded view illustrating a spent part coupling interface and the product packaging portion of FIG. 1.
Figure 3:
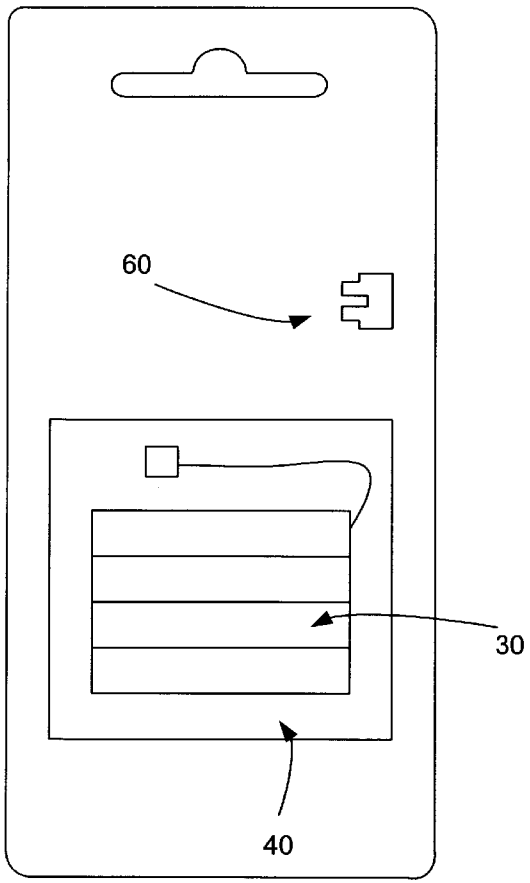

FIG. 3 illustrates the operation of the matching system of FIG. 1. In operation, the matching system is employed by a customer or a salesperson to correctly select a replacement part. For example, the customer may bring a spent battery 80 to the store. The spent battery preferably includes a cable portion 90 and a plug 70. To verify a that the battery inside the package has the same coupling interface as the part it is replacing, the consumer attempts to insert the spent battery plug 70 into the plug matching portion 60. If the plug 70 substantially fits the plug matching portion 60, the consumer has increased confidence that the correct battery plug type has been selected. On the other hand, if the plug 70 does not properly fit the plug matching the customer can either seek the assistance of a salesperson or select a different part.

Although the present invention was discussed in terms of certain preferred embodiments, the description is not limited to such embodiments. Rather, the invention includes other embodiments including those apparent to a person of ordinary skill in the art. Thus, the scope of the invention should not be limited by the preceding description but should be ascertained by reference to the claims that follow.

What is claimed is:

1. An apparatus for facilitating the identification of a compatible replacement part, the replacement part including a plug having an irregular shaped exterior cross-section, comprising:

a product packaging, the product packaging containing the replacement part, said product packaging having at least one substantially planer portion; and a coupling interface along said planer portion, said coupling interface having an irregular shape substantially following the exterior cross-section of the replacement part plug, said coupling interface adapted to mate with the replacement part plug.

2. The apparatus of claim 1, wherein said coupling interface comprises a plurality of openings.

3. The apparatus of claim 1, wherein said coupling interface shape substantially follows the exterior cross section of a female connector plug.

4. The apparatus of claim 1, wherein said coupling interface shape substantially follows the exterior cross section of a male connector plug.

5. The apparatus of claim 1, wherein said planer portion is an information card backing of a blister pack.

6. The apparatus of claim 1, wherein said product packaging is a blister portion of a blister pack.

7. A method for facilitating the matching of a replacement part plug with the plug of a spent part, the replacement part and the spent part each including a plug having an irregular shape exterior cross-section, comprising:

providing the replacement part in a substantially closed packaging; and providing a coupling portion on a section of the packaging, the coupling portion adapted to mate with the plug of the replacement part, said coupling portion having an irregular shape substantially following the exterior cross-section of the replacement part plug, wherein the plug of the replacement part substantially fits the coupling portion on the packaging and further wherein a matching of the replacement part plug with the plug of the spent part results from the plug of the spent part fitting within the coupling portion on the packaging associated with the replacement part.

8. The method of claim 7, wherein said coupling portion shape substantially follows the exterior cross section of a female connector plug.

9. The method of claim 7, wherein said coupling portion shape substantially follows the exterior cross section of a male connector plug.

10. The method of claim 7, wherein said closed packaging is a blister portiom of a blister pack.

* * * * *